United States Patent [19]

Lipsztajn et al.

[11] Patent Number: 4,853,096

[45] Date of Patent: Aug. 1, 1989

[54] PRODUCTION OF CHLORINE DIOXIDE IN AN ELECTROLYTIC CELL

[75] Inventors: Marek Lipsztajn, Rexdale; James D. McGilvery, Etobicoke; Zbigniew Twardowski, Mississauga, all of Canada

[73] Assignee: Tenneco Canada Inc., Islington, Canada

[21] Appl. No.: 156,965

[22] Filed: Feb. 18, 1988

[51] Int. Cl.[4] ..... C25B 1/26

[52] U.S. Cl. ..... 204/101; 204/95; 204/129; 204/98

[58] Field of Search ..... 204/95, 98, 128–129, 204/266, 263, 283, 284, 294

[56] References Cited

U.S. PATENT DOCUMENTS

| | | | |
|---|---|---|---|
| 3,904,495 | 9/1975 | Eng. et al. | 204/93 |
| 3,904,496 | 9/1975 | Harke et al. | 204/98 |
| 3,920,801 | 11/1975 | Grotheer | 423/477 |
| 4,294,815 | 10/1981 | Lohrberg et al. | 204/98 |
| 4,308,117 | 12/1981 | Sweeney | 204/101 |
| 4,324,635 | 4/1982 | Sweeney | 204/266 |
| 4,426,263 | 1/1984 | Hardee et al. | 204/95 |
| 4,456,510 | 6/1984 | Murakami et al. . | |
| 4,767,510 | 8/1988 | Lipsztajn | 204/101 |

*Primary Examiner*—John F. Niebling
*Assistant Examiner*—Kathryn Gorgos
*Attorney, Agent, or Firm*—Sim & McBurney

[57] ABSTRACT

Chlorine dioxide is produced electrolytically in the cathode compartment of an electrolytic cell using a three-dimensional high surface-area cathode. The cathode compartment is separated from an anode compartment by a cation-exchange membrane. Sodium chlorate is reacted with hydrogen ions and chloride ions in the cathode compartment and chlorine dioxide is vented from the cathode compartments. Chlorine co-produced with the chlorine dioxide is reduced at the cathode to provide chloride ions for the reaction while electrolytically-produced hydrogen ions are transferred across the membrane from the anode compartment to the cathode compartment to provide hydrogen ions for the reaction.

20 Claims, 2 Drawing Sheets

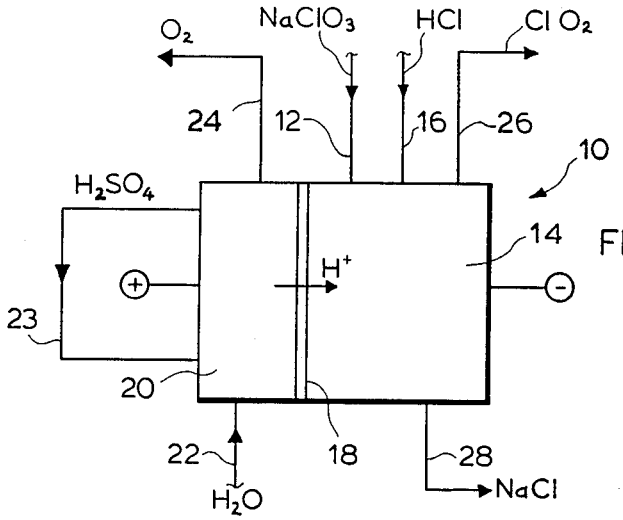
FIG.1.
FIG.3.
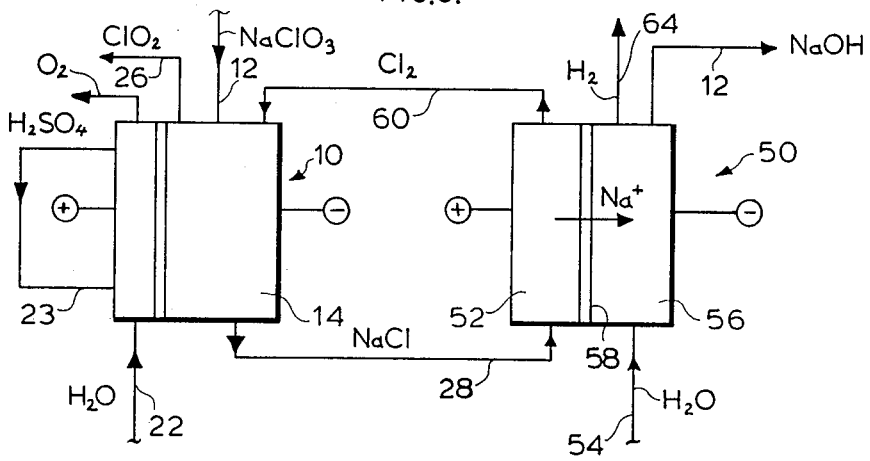

PRODUCTION OF CHLORINE DIOXIDE IN AN ELECTROLYTIC CELL

FIELD OF INVENTION

The present invention relates to the production of chlorine dioxide in substantially pure form, i.e. substantially free from chlorine.

BACKGROUND TO THE INVENTION

Chlorine dioxide is widely used as a bleaching chemical and is known to be produced by reducion of sodium chlorate in an acid aqueous reaction medium. The reaction whereby chlorine dioxide is formed, is represented by the equation:

$$ClO_3^- + Cl^- + 2H^+ \rightarrow ClO_2^- + \tfrac{1}{2}Cl_2 + H_2O$$

Generally, therefore, chlorine is co-produced with the chlorine dioxide.

Processes are known wherein the chlorine so-produced is reduced chemically, for example, using sulphur dioxide or methanol, thereby producing chloride ions for the process in situ. Such processes employ sulphuric acid as the acid source, resulting in sodium sulphate by-product.

In addition, there have been suggestions in the art to use electrolytic procedures for the production of chlorine dioxide. In this regard, the applicants are aware of U.S. Pat. Nos. 3,904,495, 3,904,496, 3,920,801, 4,308,117, 4,324,635 and 4,456,510.

With the exception of the latter patent, in each instance, chlorine dioxide is produced in conjunction with chlorine from aqueous chlorate solution in the anode compartment of a multicompartment cell. In U.S. Pat. No. 4,456,510, an aqueous sodium chlorite solution is electrolyzed to produce chlorine dioxide.

SUMMARY OF INVENTION

In accordance with the present invention, there is provided a chlorine dioxide-generating process which is carried out in the cathode compartment of a cation-exchange membrane divided cell in which co-produced chlorine is reduced electrolytically in the cathode compartment. In this way, high purity chlorine dioxide is produced in an electrolytic process from a chlorate reactant.

In the present invention, a high surface area cathode having a three-dimensional electroconductive surface is employed and chlorine dioxide is generated at the cathode and is removed from the cathode compartment substantially uncontaminated by chlorine.

Chlorine dioxide is generated chemically in the cathode compartment according to the equation:

$$NaClO_3 + 2H^+ + 2Cl^- \rightarrow ClO_2 + \tfrac{1}{2}Cl_2 + NaCl + H_2O$$

Employing the electrode and potential and other conditions described in more detail below results in selective electrolytic reduction of the chlorine co-produced with the chlorine dioxide in the cathode compartment to chloride ions, leaving the product chlorine dioxide exiting from the cathode compartment substantially free from the chlorine Water is fed to the anolyte compartment of the cell, after an initial charge of an oxy-acid. The electrolysis carried out in the cell produces oxygen gas, which is vented from the anode compartment, and hydrogen ions, which migrate across the cation-exchange membrane into the anode compartment to provide hydrogen ions therein for the chemical reaction producing chlorine dioxide therein. For each gram-atom of Cl reduced electrochemically in the cathode compartment, 1 mole of $H^+$ is transferred into the cathode compartment, thereby providing 1 mole of the two moles of hydrogen ions and chloride ions required for continuous operation. Accordingly, the cathode compartment requires the feed of 1 mole of sodium chlorate, 1 mole of hydrogen ions and 1 mole of chloride ions to maintain the chlorine dioxide production as a continuous process.

Alternately, ½ mole of chlorine may be fed to the cathode compartment along with one mole of sodium chlorate. In this case, two moles of $H^+$ are transferred from the anode compartment to the cathode compartment to satisfy the hydrogen ion requirement of the process, while the ½ mole of chlorine fed to the cathode compartment and the ½ mole of chlorine co-produced in the cathode compartment are electrochemically reduced to provide the two moles of chloride ions.

BRIEF DESCRIPTION OF DRAWINGS

FIG. 1 is a schematic representation of an electrolytic cell for the production of chlorine dioxide in accordance with one embodiment of the invention;

FIG. 3 is a schematic representation of the integration of an electrolytic cell for the production of chlorine dioxide with an electrolytic cell for the production of sodium hydroxide and chlorine.

DESCRIPTION OF PREFERRED EMBODIMENTS

Figure 2:
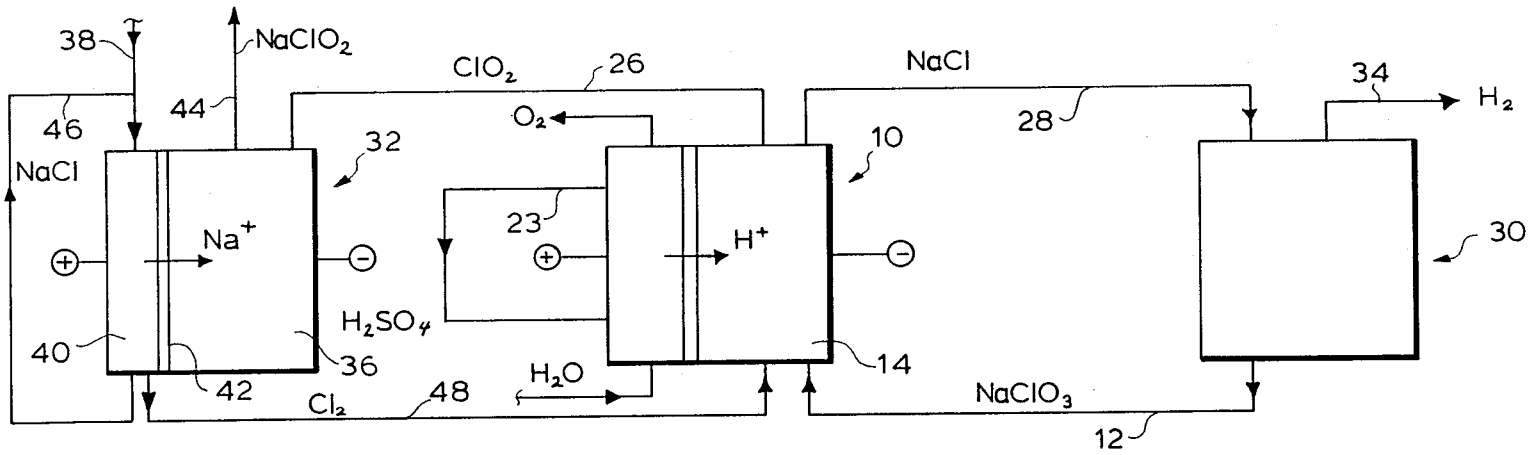
FIG. 2 is a schematic representation of the integration of an electrolytic cell for the production of chlorine dioxide with an electrolytic cell for the production of sodium chlorite, in accordance with another embodiment of the invention.

Referring first to FIG. 1, there is shown therein an electrolytic cell 10 for the production of chlorine dioxide in accordance with one embodiment of the invention. Aqueous sodium chlorate solution is fed by line 12 to the cathode compartment 14 of the cell 10, which contains a three-dimensional electrode. An acid, preferably hydrochloric acid, also is fed to the cathode compartment 14 by line 16.

The aqueous sodium chlorate solution fed by line 12 has a concentration sufficient to establish, at its flow rate, a relatively high concentration of sodium chlorate in the cathode compartment 14, generally greater than about 5 molar, preferably about 5 to about 6.5 molar. Usually, the sodium chlorate feed solution has a concentration in the range of about 3 to about 7 molar.

The cell 10 has a cation-exchange membrane 18 separating the cathode compartment 14 from an anode compartment 20. After an initial charge of an oxy-acid, usually sulfuric acid, water is fed by line 22 to the anode compartment 20 and hydrogen ions produced by electrolysis of the anolyte migrate across the cation-exchange membrane 18 to the cathode compartment 14. The anolyte sulfuric acid solution is recirculated by line 23.

The hydrogen ion migration across the cation-exchange membrane 18 and the feed of hydrochloric acid by line 16 establish a total acid normality in the cathode compartment 18 of at least about 0.01 normal, preferably at least about 0.05 normal.

The oxygen co-produced in the electrolysis step in the anode compartment is vented by line 24 from the anode compartment 20.

In the cathode compartment 14, the sodium chlorate fed by line 12 reacts chemically with the hydrogen ions and chloride ions fed by line 16, the electrolytically-produced hydrogen ions transferred across the cation-exchange membrane and the chloride ions electrolytically produced in the cathode compartment 14 as described below, to form chlorine dioxide and chlorine in accordance with the equation:

$$NaClO_3+2H^++2Cl^-\rightarrow ClO_2+\tfrac{1}{2}Cl_2+NaCl+H_2O$$

One-half of the hydrogen ion requirement is provided by the acid fed by line 16 with the remainder of the hydrogen ion requirement is provided by the hydrogen ions transferred from the anode compartment 20.

The co-produced chlorine is reduced under the electrochemical conditions which exist in the cathode compartment 14, selectively with respect to the chlorine dioxide present therein. The chloride ions so produced provide half the chloride ions for the chemical reduction of the chlorate, with the remainder of the chloride ions being provided by the hydrochloric acid feed in line 16, or from some other convenient external source of chloride ions, such as sodium chloride.

Depending on the electrolytic conditions in the cathode compartment, the chloride ions may be produced directly from the co-produced chlorine by electrochemical reduction, in accordance with the equation:

$$\tfrac{1}{2}Cl_2+e\rightarrow Cl^-$$

or indirectly by reduction chemically with chlorite ion electrolytically produced from chlorine dioxide, in accordance with the equations:

$$ClO_2+e\rightarrow ClO_2^-$$

$$\tfrac{1}{2}Cl_2+ClO_2^-\rightarrow ClO_2+Cl^-$$

In this latter procedure, the chlorite ion formation is controlled so as to avoid further electrolytic reduction of chlorite, which inefficiently produces chlorine.

The chlorine concentration in the product off-gas stream in line 26 may be monitored and the current applied to the cell is used to control the chlorine concentration.

The feeds of sodium chlorate by line 12 and of ohloride ions by line 16 as well as the electrochemically-produced chloride ions establish a chlorate to chloride ion ratio in the cathode compartment 14 generally at least about 1:1, preferably about 2:1 to about 4:1.

The electrode potential which is applied to the cathode is more positive than −1 volt as compared with a saturated calomel electrode (SCE) and as determined at the current feeder to the cathode and more negative than the open circuit potential under the prevailing conditions, preferably about −0.2 volt.

The electrode potential of the cathode refers to the solution potential measured at the current feeder, in analogous manner to a flat plate electrode. A three-dimensional electrode, such as employed herein, inherently has a distribution of potential within the structure and the actual potential will depend on the location of determination and may be more negative than −1 volt vs. SCE.

The cathode compartment 14 preferably is maintained at an elevated temperature to assist in the rate of chlorine dioxide formation. Usually, a temperature in excess of about 50° C. is employed, preferably about 60° C. to about 70° C.

Alternatively, chlorine can be fed to the cathode compartment 14 in place of the hydrogen ions and chloride ions in line 16, for selective reduction to chloride ions along with the selective reduction of the co-produced chlorine. In this case, the anolyte feed is increased so as to provide twice as much hydrogen ion migration across the membrane 18 and hence provide all the hydrogen ion requirement of the cathode compartment 14.

The chlorine dioxide produced in the chemical reaction, substantially free from chlorine, is vented from the cathode compartment 14 as the product gas stream by line 26. This chlorine dioxide stream may be utilized further, as described, for example, with respect to the embodiment of FIG. 2 below.

The by-product sodium chloride from the chemical production of chlorine dioxide is removed from the cathode compartment as an aqueous solution by line 28. This aqueous sodium chloride solution may be forwarded to a chlorate cell for electrolytic conversion to aqueous sodium chlorate solution for recycle to the cathode compartment 14 to provide at least part of the sodium chlorate in line 12.

The cathode employed in the cathode compartment 14 is a high surface area electrode having a three-dimensional electrolyte-contacting surface, which permits a long contact time between the reactants.

The term "high surface area" in relation to the cathode refers to an electrode of the type wherein the electrolyte is exposed to a large surface area of electrode surface in comparison to the physical dimensions of the electrode. The electrode is formed with interstices through which the electrolyte flows, and so has a three-dimensional surface of contact with the electrolyte.

The high surface area cathode may be the so-called "flow through" type, wherein the electrode is formed of electroconductive porous material, for example, layers of electroconductive cloth and the electrolyte flows through the porous structure generally parallel to the current flow while being subjected to electrolysis, and thereby is exposed to the high surface area of the mesh of the electrode.

The high surface area cathode also may be the so-called "flow by" type, wherein the electrode comprises a packed bed of individual electroconductive particles and the electrolyte flows through the packed bed generally perpendicular to the current flow while being subjected to electrolysis, and thereby is exposed to the high surface area of the electroconductive particles in the packed bed.

The electrode may be constructed of materials having a low overpotential or preferably high overpotential, particularly graphite, for the reaction $Cl_2\rightarrow Cl^-$. As is well known to those skilled in the electrochemical art, the overpotential of an electrode towards the electrochemical reaction $Cl_2/Cl^-$ refers to the relationship of the potential applied to the electrode to the equilibrium potential to sustain the electrochemical reaction at a reasonable rate. If the electrode potential is close to the equilibrium potential, then the electrode is considered to have a "low" overpotential while, if a much more negative potential is required to achieve a significant reduction rate, then the electrode is considered to have a "high" overpotential.

Materials of construction of such low overpotential electrodes are known and are employed in the so-called "Dimensionally Stable Electrodes". Such electrodes generally comprise a substrate, which is titanium, zirconium, tantalum or hafnium, having an electroconductive coating thereon, which may be a precious metal, for example, platinum; a precious metal alloy, for example, a platinum-iridium alloy; a metal oxide, for example, ruthenium oxide or titanium dioxide; a platinate, for example, lithium platinate or calcium platinate; or mixtures of two or more of such materials. Any of these materials may be employed to provide the material of construction of a low overpotential cathode.

The cell 10 in which the electrolytic production of chlorine dioxide is effected in accordance with the present invention may have any convenient construction. Usually, the cell is divided into anolyte and catholyte compartments 20 and 14 by an ion-exchange membrane 18, usually a cation-exchange membrane so as to promote hydrogen ion transfer and to prevent the interaction of gases produced at the anode, usually oxygen, with the chlorine dioxide and the electroreduction at the cathode. The anode of the cell may be constructed of any desired electroconductive material, for example, graphite or metal.

Referring now to FIG. 2, there is shown the integration of the chlorine dioxide generator 10 of FIG. 1 with a chlorate cell 30 and a chlorite-generating cell 32, as described in more detail below. In this embodiment, the sodium chloride by-product in line 28 is forwarded to the chlorate cell 30, wherein the sodium chloride is electrolyzed to form sodium chlorate, which is recycled by line 12 to the chlorine dioxide generator 10. By-product hydrogen from the electrolysis in the chlorate cell 30 is vented by line 34.

Chlorine dioxide formed in the generator 10 is forwarded by line 26 to the cathode compartment 36 of the chlorite-generating cell 32. Sodium chloride is fed by line 38 to an anode compartment 40 of the chlorite-generating cell 32. Anodic electrolysis produces chlorine while sodium ions migrate across a cation-exchange membrane 42 separating the anode compartment 40 from the cathode compartment 36. In the cathode compartment, the chlorine dioxide forwarded by line 26 forms chlorite ions, resulting in a discharge of sodium chlorite solution in line 44 from the cathode compartment 36.

Depleted sodium chloride solution exiting the anode compartment 40 is recycled by line 46; The chlorine formed in the anode compartment 40 is passed by line 48 to the cathode compartment 14 of the chlorine dioxide generator 10. In comparison to FIG. 1, all the hydrogen ions and chloride ions for the cathodic production of chlorine dioxide are produced in situ in compartment 14 from the chlorine fed by line 48 and hydrogen ion migration. This result is achieved by increasing the current supplied to the cell from 1 Faraday to 2 Faradays per mole of chlorine dioxide produced.

The overall process between the chlorine dioxide generator 10 and the chlorite cell 32 (theoretically) requires no additional input of hydrogen ions and/or chloride ions, since all the hydrogen ions and/or chloride ions required by the chlorine dioxide generator are provided within the system and no chlorine output requires to be handled. Further integration with the chlorate cell produces a system wherein the only inputs are sodium chloride and power and the only outputs are sodium chlorite, hydrogen and oxygen.

A modification of the procedure of FIG. 2 involves forwarding sodium chloride from the anolyte chamber 40 of the chlorite-generating cell 32 to the chlorate cell 30. In addition, any hypochlorous acid in the hydrogen off-gas stream 34 may be condensed and recycled to cathode compartment of the chlorine dioxide generator 10.

In FIG. 3, there is illustrated integration of the chlorine dioxide generator 10 with a caustic-chlorine cell 50. In this case, the sodium chloride by-product, along with unreacted sodium chlorate, is forwarded by line 28 to the anode compartment 52 of the caustic-chlorine cell 50. An electrolyte is forwarded by line 54 to the cathode compartment 56 of the caustic-chlorine cell 50, separated from the anode compartment 52 by a cation-exchange membrane 58.

Chlorine produced in the anode compartment 52 is forwarded as an aqueous solution in the unreacted sodium chlorate, by line 60 to the cathode compartment of the chlorine dioxide generator 10. Sodium hydroxide is recovered from the cathode compartment 50 as product in line 62 and by-product hydrogen gas is vented by line 64.

The overall process for the FIG. 3 embodiment is depicted by the equation:

$$H_2O + NaClO_3 + 2e \rightarrow ClO_2 + NaOH + \tfrac{1}{2}O_2 + \tfrac{1}{2}H_2$$

The input requirements are sodium chlorate and power to produce chlorine dioxide, sodium hydroxide, oxygen and hydrogen. The sodium hydroxide is useful elsewhere in the mill and the by-product gases may be vented.

EXAMPLE

An experimental cell was set up as seen in FIG. 1. The cell was a conventional MP cell from Electrocell AB which had been modified to accommodate a three-dimensional electrode formed by inserting a graphite felt (Union Carbide Corporation) into the cathode compartment. The cell was divided into anode and cathode compartments by a cation exchange membrane (NAFION 120). The membrane area was 1 sq.dm while the area of the cathode was estimated to be approximately 100 to 1000 times the membrane area. An oxygen-evolving dimensionally-stable electrode was used as the anode.

Feed to the cathode compartment was 8.626 moles of sodium chlorate, 2.356 moles of sodium chloride and 1.536 moles of HCl. 6N $H_2SO_4$ was used as the anolyte. An electrode potential of about −0.7 volts vs. SCE was applied to the cathode at a current density of 1.97 $kA/m^2$ for a period of 4 hrs at 70° C. The effluent from the cathode chamber contained 7.659 moles $NaClO_3$ and 3.548 moles NaCl. The off-gases were analyzed and contained 0.626 moles of $ClO_2$ and 0.068 moles of $Cl_2$.

The chlorine dioxide had a purity of 90.2%, produced at a chemical efficiency of 82.2%.

SUMMARY OF DISCLOSURE

In summary of this disclosure, the present invention provides a novel electrolyte process for the production of chlorine dioxide in substantially pure form. Modifications are possible within the scope of this invention.

What is claimed is:

1. An electrolytic process for the production of chlorine dioxide, which comprises:

providing an electrolytic cell having a cathode compartment with a three-dimensional high surface-area cathode therein and an anode compartment separated from the cathode compartment by a cation-exchange membrane, feeding chlorate ions to the cathode compartment and providing hydrogen ions and chloride ions in said cathode compartment, reducing said chlorate ions with said hydrogen ions and chloride ions in said cathode compartment to form chlorine dioxide while an electric current is applied to the cathode compartment to reduce chlorine co-produced with said chlorine dioxide to chloride ions, venting chlorine dioxide so produced, and electrolytically forming hydrogen ions in said anode compartment and transferring said hydrogen ions across said cation exchange membrane from said anode compartment to said cathode compartment.

2. The process of claim 1 wherein said hydrogen ions and chloride ions in said cathode compartment are provided in part by said hydrogen ions transferred to said cathode compartment from said anode compartment and by said chloride ions produced by electrolytic reduction of said co-produced chlorine, and in part by hydrogen ions and chloride ions fed to said cathode compartment from external sources.

3. The process of claim 2 wherein said external source hydrogen ions and chloride ions are provided by hydrochloric acid.

4. The process of claim 1 wherein said hydrogen ions and chloride ions in said cathode compartment are provided, for hydrogen ions, wholly by said hydrogen ions transferred to said cathode compartment from said anode compartment and, for chloride ions, in part by said chloride ions produced by electrolytic reduction of said co-produced chlorine and in part by chloride ions produced by electrolytic reduction of chlorine fed to said cathode compartment from an external source.

5. The process of claim 1 wherein said cathode compartment has a sodium chlorate concentration of at least about 5 molar and a total acid normality of at least about 0.01N.

6. The process of claim 1 wherein an eleotrode potential is applied to the cathode which is more positive than −1 volt as compared with a saturated calomel electrode and as determined at the current feeder to the three-dimensional cathode and more negative than the open circuit potential under the prevailing conditions.

7. The process of claim 6 wherein said cathode comprises stacked layers of electroconductive mesh material through the interstices of which percolates the chlorate solution generally parallel to the current flow.

8. The process of claim 6 wherein said cathode comprises a packed bed of individual electroconductive particles through which percolates the chlorate solution generally perpendicular to the current flow.

9. The process of claim 6 wherein said cathode is constructed of a material having a high overpotential for the reaction $Cl_2 \rightarrow Cl^-$.

10. The process of claim 9 wherein said high overpotential electrode material is graphite or other carbonaceous material.

11. A continuous electrolytic process for the production of chlorine dioxide, which comprises:

continuously feeding aqueous sodium chlorate solution to a cathode compartment of an electrolytic cell wherein the cathode compartment is provided with a three-dimensional high surface-area cathode therein and is separated from an anode compartment by a cation-exchange membrane, continuously reducing said sodium chlorate in said cathode compartment with hydrogen ions and chloride ions to form chlorine dioxide and chlorine in accordance with the equation:

$$NaClO_3 + 2H^+ + 2Cl^- \rightarrow ClO_2 + \tfrac{1}{2}Cl_2 + H_2O + NaCl$$

while an electric current is applied between the anode and cathode compartments, continuously electrolytically reducing said chlorine co-produced with said chlorine dioxide to chloride ions in said cathode compartment to provide part of the chloride ions used in said reduction of sodium chlorate, continuously electrolytically forming hydrogen ions from an electrolyte in said anode compartment and transferring said electrolytically-formed hydrogen ions from said anode compartment to said cathode compartment to provide at least part of the hydrogen ions used in said reduction of sodium chlorate, continuously providing the balance of hydrogen ions and chloride ions used in said reduction of sodium chlorate in said cathode compartment, continuously venting chlorine dioxide so produced, and continuously removing a by-product stream of sodium chloride solution from said cathode compartment.

12. The process of claim 11, wherein about 1 Faraday of electrical current is applied to the cell per mole of chlorine dioxide produced, whereby said electrolytically-reduced chlorine and said hydrogen ions transferred from said anode compartment provide approximately one half of the molar quantity of said hydrogen ions and chloride ions used in said reduction of sodium chlorate, and the remainder of the molar quantity of said hydrogen ions and chloride ions used in said reduction of sodium chlorate is provided continuously by hydrogen ions and chloride ions from sources external of said cathode compartment.

13. The process of claim 12 wherein said external sources of hydrogen ions and chloride ions are provided by hydrochloric acid.

14. The process of claim 11, wherein about 2 Faradays of electrical current are applied to the cell per mole of chlorine dioxide produced, whereby said hydrogen ions transferred from said anode compartment provide substantially all of the molar quantity of said hydrogen ions and said electrically reduced chlorine provides approximately one-half of the molar quantity of said chloride ions used in said reduction of sodium chlorate, and the remainder of the molar quantity of said chloride ions used in said reduction of sodium chlorate is provided by feeding chlorine continuously from an external source to said cathode compartment and electrolytically reducing said chlorine to said remainder of aid chloride ions.

15. The process of claim 11, wherein said catholyte has a chlorate concentration of about 5 to about 6.5 molar, a chlorate to chloride ion ratio of about 2:1 to about 4:1, a total acid normality of at least about 0.05 normal, and a temperature of at least abut 50° C.

16. The process of claim 15 wherein said temperature is about 60° C. to about 70° C.

17. The process of claim 14 which is integrated with a sodium chlorite-producing electrolytic process wherein said chlorine dioxide is electrolytically reduced to chlorite ions, chlorine is electrolytically formed and is forwarded to said cathode compartment to provide said chlorine feed thereto.

18. The process of claim 17 which is further integrated with a sodium chlorate-producing electrolytic process wherein by-product sodium chloride from said cathode compartment is electrolyzed to provide said sodium chlorate feed to said cathode compartment.

19. The process of claim 14 which is integrated with a caustic-chlorine cell wherein by-product sodium chloride from said cathode compartment is electrolyzed to provide said chlorine feed to said cathode compartment.

20. The process of claim 11 wherein an electrode potential is applied to the cathode which is more positive than −1 volt as compared with a saturated calomel electrode and as determined at the current feeder to the three-dimensional electrode and more negative than the open circuit potential under the prevailing conditions.

* * * * *